US006877708B1

(12) United States Patent
Thurner

(10) Patent No.: US 6,877,708 B1
(45) Date of Patent: Apr. 12, 2005

(54) STAND FOR CLAMPING ROD-SHAPED PARTS

(75) Inventor: Guenther Thurner, Strasskirchen (DE)

(73) Assignee: Krinner Innovation GmbH, Strasskirchen (DE)

( * ) Notice: Subject to any disclaimer, the term of this patent is extended or adjusted under 35 U.S.C. 154(b) by 121 days.

(21) Appl. No.: 10/349,653

(22) Filed: Jan. 23, 2003

(30) Foreign Application Priority Data

Jan. 25, 2002 (DE) ..... 102 02 890
May 10, 2002 (DE) ..... 102 20 879

(51) Int. Cl.[7] ..... F16M 13/00
(52) U.S. Cl. ..... 248/519; 348/346.06
(58) Field of Search ..... 248/519, 346.06, 248/523, 525, 520, 524, 526

(56) References Cited

FOREIGN PATENT DOCUMENTS

DE 39 32 473 4/1991
DE 100 00 879 7/2001
DE 201 05 005 8/2001

*Primary Examiner*—Leslie A. Braun
*Assistant Examiner*—Kofi Schulterbrandt
(74) *Attorney, Agent, or Firm*—Jordan and Hamburg LLP

(57) ABSTRACT

A stand for clamping rod-shaped parts has a foot part with a base plate and a seating region, which is formed by a wall contour with individual wall regions. The rod-shaped part is inserted with its lower end into the opening of the seating region and initially fixed by means of an arbor. Pivotable holding elements are placed against the rod-shaped part by means of a tensioning device. The holding elements are actuated by the tensioning device, which has a tensioning lever, a drum and a housing. A flexible connecting element, which pulls the holding element inward into the clamping position, is pulled together by means of the tensioning device. In order to introduce forces gently, the ends of the flexible connecting part are guided from the holding elements to the tensioning device in a special guiding block, which consists of a material which can be subjected to higher loads than can the material of the remaining foot part.

25 Claims, 7 Drawing Sheets

Figure 1:
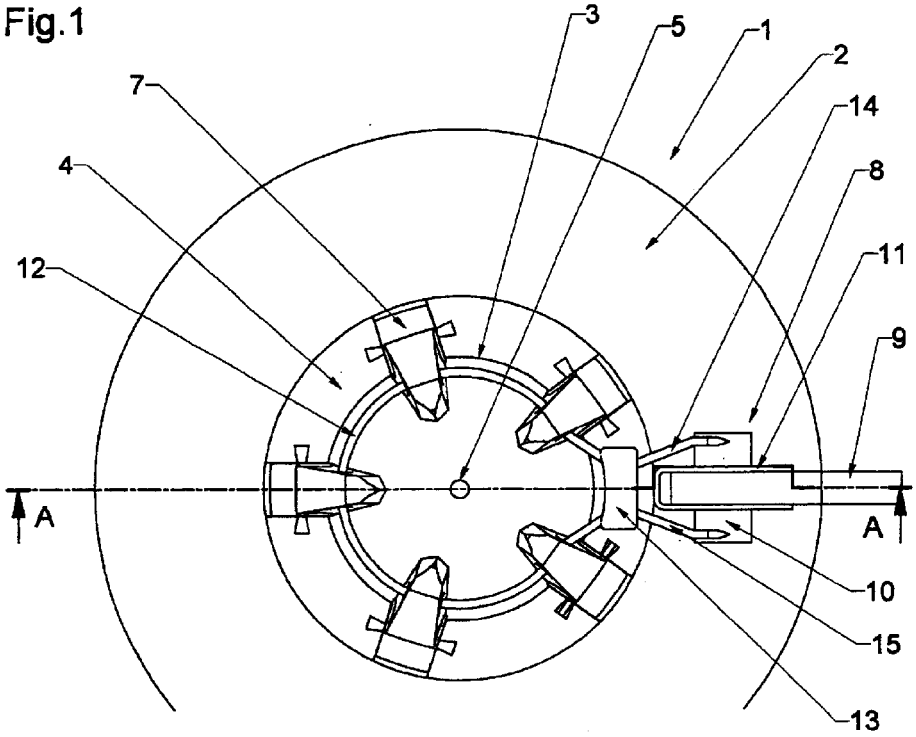

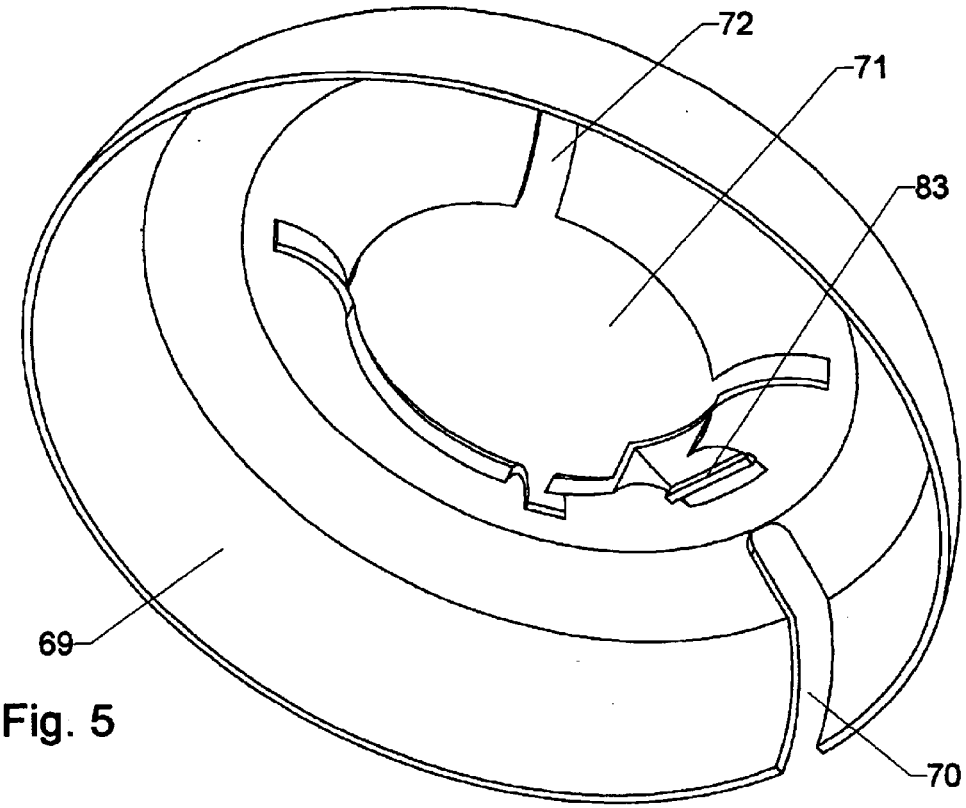
Fig. 5
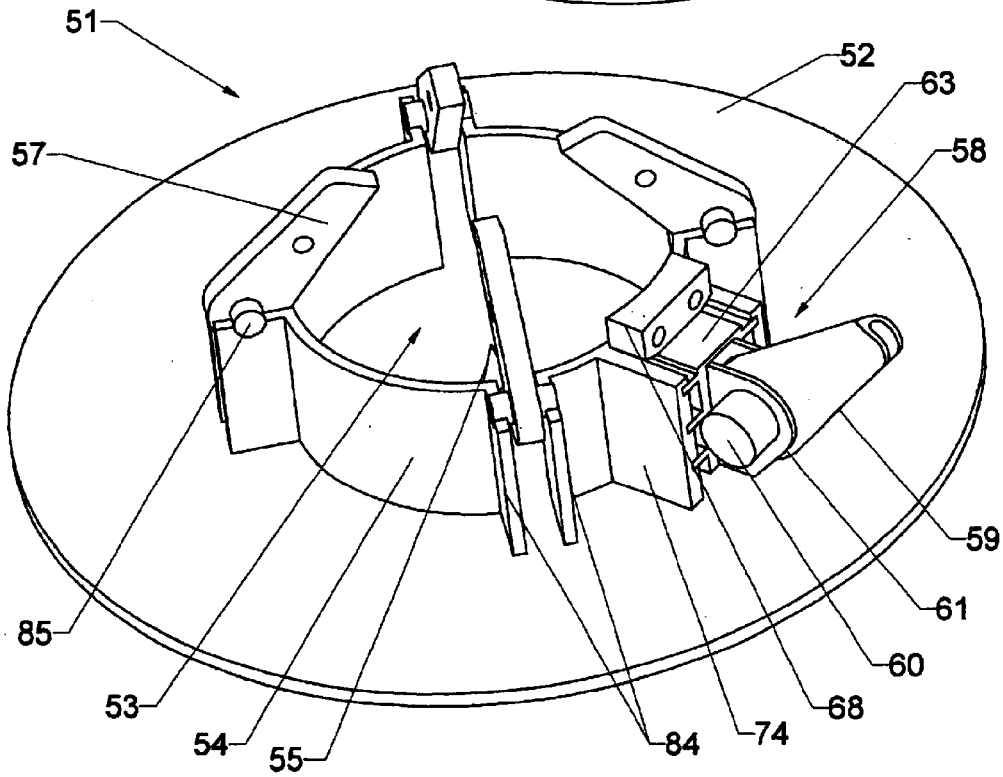

STAND FOR CLAMPING ROD-SHAPED PARTS

The invention relates to a stand for clamping rod-shaped parts, particularly Christmas trees, with a foot part, with a seating region, which is at the foot part and formed by a wall contour for the end of the rod-shaped part, which is to be fastened, with several holding elements, which are disposed around an axis of symmetry and can each be swiveled in a plane, between an open position and a holding position the planes intersecting approximately in the axis of symmetry, with a tensioning device, which can be loaded in tension and tensions a flexible connecting part, which is guided in the form of an approximately closed loop movably through all holding elements and, when the tensioning device is actuated, can be swiveled out of the open position into the holding position and with a separate guide part, which is provided at the foot part, by means of which at least one end of the flexible connecting part, which is formed into a loop, can be passed out of the region of the loop to the outside, in accordance with the introductory portion of claim 1.

A stand of this type is essentially known from the DE 39 32 473 C2. It is an essential distinguishing feature of this known stand that the flexible connecting part, in practice a steel rope, is passed movably through openings in all holding elements. When the tensioning device is actuated, the connecting part slides in the openings of the holding elements, as a result of which the latter are pulled with essentially the same holding force against the end of the rod-shaped part, which is to be fastened. This also takes place when the end, which is to be fastened, does not have a strictly circular contour, as in the case, for example, of Christmas trees. The known stand has the advantageous property that, by a simple actuation of the tensioning device, the rod-shaped part is clamped reliably in the desired position. Its use as a Christmas tree stand is therefore widespread.

The function of the known stand also depends on whether the rope, guided in the form of an approximately closed loop movably through all holding elements, assumes as far as possible the shape of a regular polygon. For this reason, the holding elements can be swiveled in planes, which are disposed symmetrically to the axis of symmetry. However, it is not possible to maintain the contour of a regular polygon precisely, since the flexible connecting part must be connected at least at one end with the tensioning device and, for this purpose, is passed to the outside out of the region of the holding elements.

Moreover, an embodiment is shown in the DE 39 32 473 C2, for which one end of the flexible connecting part is fastened to the foot part of the stand, while the other end is taken to the tensioning device, which, in turn, is supported at a base plate and at the seating area for the end, at which the rod-shaped part is fastened.

On the other hand, the Christmas tree stand of DE 201 05 005 U1 shows an embodiment, for which both ends of the flexible connecting part are passed to the outside jointly at a place between two holding elements and connected there with the tensioning device. An angular guiding part, which rests on the foot part, serves for the guiding. The tensioning device, which may be a latch device, is provided at a distance radially to the outside. No details are provided in the DE 201 05 005 U1 concerning the mutual arrangement and attachment of the guiding part and the tensioning part to the foot part.

Appreciable tensile forces must be applied by the holding elements so that rod-shaped parts are held securely and very high forces, which lead to local stress peaks in the housing, therefore also occur in the region of the tensioning device. This is especially so for the place at which the ends of the flexible connecting part are passed out of the region of the holding elements and to the tensioning device. Stands of this type, particularly in the form of Christmas tree stands, are mass produced products and are subject to strong price pressures on the market. However, because of the aforementioned stress peaks, high-grade materials are required for a reliable mode of operation. Accordingly, contradictory requirements arise, according to which, on the one hand, it must be possible to produce such stands relatively inexpensively and simply and, on the other, such a stand must be able to apply the required holding forces safely and harmlessly over a period of years. This is especially so for use as a Christmas tree stand because, if the holding function were to fail, a fire could easily arise in the room or the house.

It is therefore an object of the invention to create a stand of the type named above, which ensures the required holding forces, functions reliably for many years and, nevertheless can be produced and installed relatively inexpensively and easily.

According to the characterizing part of claim 1, this objective is accomplished owing to the fact that the guiding part is a guiding block, which is inserted in a recess in the wall contour and is in direct contact with the tensioning device and over which the reaction force, corresponding to the tensile force, is transferred from the tensioning device to the foot part.

Accordingly, pursuant to the invention, the guiding part, which is used to guide the flexible connecting part and in which the tensile forces of the flexible connecting part must be absorbed, is constructed in the form of a guiding block and inserted in a recess of the wall contour. As a consequence of this construction, the guiding block absorbs the local stresses and passes them on uniformly to the foot part and the tensioning device. The guiding block can therefore be produced from a material, which can be subjected to higher stresses, than can the material, of which the remaining foot part consists. This leads to special advantages when such a stand, as is preferred, is produced from plastic, because a plastic of normal quality is largely sufficient for such a stand, whereas a plastic part of high strength, which may consist, for example, of nylon, polyester, polypropylene or the like, with or without fiber reinforcement, may be used for the guiding block. However, the advantage of the inventive stands is not limited to those produced from plastic. For example, the advantage may also be achieved when the foot part may also be produced from a wooden material, the stresses on which are relieved by a guiding block of metal.

Since the guiding part is constructed in the form of a solid block, a stable configuration is possible, which is suitable for larger loads and makes a reliable guidance of the flexible connecting part possible. The arrangement of the guiding block in a recess of the wall contour makes a reliable and uniform transfer of forces from the tensioning device to the wall contour and, with that, to the foot part of the stand possible. In addition, since the guiding block is in direct contact with the tensioning device, local overloading of the wall contour and of the foot part is avoided. The guiding block can be configured in such a manner, that it passes on the compressive forces, acting directly on it and originating from the tensioning device, uniformly and selectively to the wall contour and with that to the foot part. At the same time, a simple installation becomes possible. Since the tensioning device touches the guiding block directly, the two parts can be held and guided jointly. With that, the object of the invention, given above, is achieved completely. At the same time, there is the advantageous effect that the reaction force of the tensioning device, corresponding to the tensile force, is transferred over the guiding block completely and selectively to the foot part of the stand.

In the event that the foot part consists of plastic, it has proven to be appropriate for the guiding block to consist of a nylon, especially of a glass fiber-reinforced nylon. This material is a match for all loads, which may come about in the present application. Moreover, it can easily be converted into any appropriate shape, so that, for example, rounded corners can easily be incorporated for the wear-resistant guidance of the flexible connecting part.

The inventive stand is advantageous already when only the one end of the flexible connecting part is passed through and connected with the tensioning device, while the other end is fastened in the region of the holding elements to the foot part. Preferably, however, both ends of the flexible connecting part are passed through to the guiding block to the tensioning device and connected with the latter. The relatively high local load in the region of the tensioning device, which comes about thereby, is transferred satisfactorily by the guiding block from the tensioning device to the foot part and vice versa. By means of this construction, it is achieved that the rope approaches the shape of a uniform polygon almost completely. The flexible connecting part then slides satisfactorily in the openings of the holding elements and it is realized to a large extent that these are in contact with the fastening end of the rod-shaped parts with almost the same tensile force.

A particularly advantageous form of guiding the flexible connecting part consists therein that the guiding block has two boreholes and that one end of the flexible connecting part is passed through each of the boreholes. Admittedly, guidance in open slots or grooves is also possible in principle. However, the guidance in boreholes ensures that the flexible connecting part can never escape unintentionally from the guiding block.

If the inventive stand is provided with a circular wall contour, which extends upward from the base plate of the foot part, an advantageous embodiment consists therein that the guiding block is pushed from below into an opening, which forms the recess in a wall region of the circular wall contour. The circular wall contour may be formed, for example by special wall regions which complete one another in the form of a cylindrically open container to form a circular shape. At the same time, the pivot axes of the holding element may be provided in gaps between the individual wall regions. When the guiding block is pushed into one of these wall regions of circular contour, then this means that it is directly in the area of the flexible connecting part without any additional expense for materials.

The requirement that the guiding block transfers, at the same time, the reaction force, corresponding to the tensile force, from the tensioning device to the foot part, is fulfilled structurally most easily owing to the fact that the tensioning device, at the region of the circular wall contour accommodating the guiding block, is disposed pointing somewhat radially to the outside in relation to the axis of symmetry. At the same time, forces can be transferred in the radial direction between the guiding block and the tensioning device.

In accordance with an additional further development, it is achieved in a simple way that the tensioning device is in direct contact with the guiding block over the opening in the circular wall contour. For this purpose, the guiding block is provided with a projection, which reaches through the opening, lies in contact with the tensioning device and transfers forces. In this way, forces are transferred directly between the guiding block and the tensioning device.

Furthermore, a second inventive structural shape is proposed which also requires a seating region in the form of a circular wall contour, which extends upward from a base plate of the foot part. The guiding block here is part of the circular wall contour. The wall thicknesses of the circular wall contour and of the guiding block are additive here, so that, overall, the wall regions of the circular wall contour can have a lesser wall thickness here than in the case of the first construction with the guiding block pushed into a cavity of the wall region. In this case, however, a larger force transfer area of the guiding block is required.

Therefore, in a development of this second, inventive construction, the guiding block has a reinforced middle part as well as two lateral wings, the middle part having the region for guiding the ends of the flexible connecting part and being in contact with the tensioning device and the lateral wings forming enlarged surface for contacting the circular wall contour. In this way, the high forces, originating from the tensioning device, are transferred over a large surface to the foot part, so that local stress peaks are avoided in the material of the foot part, which cannot be subjected to such high stresses.

A third, inventive embodiment is based on a guide, which extends radially in relation to the axis of symmetry, the guiding block being pushed from outside into the guide up to a stop. This embodiment, together with further developments, enables the stand to be constructed from individual components, which can be combined in the form of modulars. The guide can be formed by guiding walls, which are formed at the wall contour, start out from the seating area, lead to the outside and, by means of ribs and grooves, hold the guiding block so that it can slide in the radial direction. Advantageously, the ribs are disposed at the guiding block and, with rounded-off edges, change over into side surfaces of the guiding block. In the assembled state, the side wall regions between the ribs of the guiding block are at a distance from the adjacent guiding walls. As a consequence of this configuration, the ribs are provided with a certain flexibility in their transition region to the guiding block. This flexibility is of advantage for the assembly as well as for the stability. In this connection, the ribs may have a rectangular or an undercut profile, such as a dovetailed profile.

The previously named details of the third embodiment make easy installation, secure holding and a good transfer of forces at the guiding block possible. However, the greatest advantage of this embodiment arises only from a further development, according to which the guiding block is constructed as a holder for the tensioning device. Namely, as a consequence of this development, the tensioning device and the guiding block can be assembled outside of the stand and then inserted in the stand as a common unit.

The device may be held at the guiding block, for example, owing to the fact that the guiding block is provided with a recess, which holds and accommodates at least regionally the tensioning device. Moreover, the recess in the guiding block can, in relation to the installed state of the latter, be open radially to the outside and in the direction of the foot part and form a guide, which extends essentially parallel to the axis of symmetry and into which the tensioning device is pushed at least regionally from the side facing the foot part up to a stop.

Moreover, the refinement may be such that there is profiling of ribs and a grooves, which enables the housing to slide in a direction parallel to the axis of symmetry yet prevents migration radially to the axis of symmetry, between the housing of the tensioning device and the walls of the recess.

The stop, which limits the pushing-in movement of the tensioning device into the guiding block, is formed advantageously according to a further development by the inner wall of an upper region of the guiding block, which functions as a rope guide and, in the installed state of the guiding block, protrudes upward ever the seating region of the stand.

As a consequence of the last-mentioned structural measures, the pushing-in directions of the guiding block into the stand and the tensioning direction in the guiding block extend at right angles to one another. In conjunction with the stop limitations that have been provided, this causes the two parts that are to be installed, namely the guiding block and the tensioning device, to block one another mutually to a certain extent and prevents them from becoming detached automatically in operation. At the same time, this construction makes possible an assembly without additional fasting means such as screws, sites of adhesion or the like.

In this connection, provisions are made in accordance with a further advantageous refinement that the safeguard against displacement of the tensioning device inserted in the guiding block in the direction of the foot part is accomplished by at least one cam, which is constructed at the stand and which, when the guiding block is pushed in, lies in the displacement path of the tensioning device within the guiding block.

Furthermore, the stop, which limits the pushing-in movement of the guiding block inward in the direction of the axis of symmetry, is formed in an advantageous manner by the seating region of the foot part. The seating region may be formed, for example, by a peripheral wall, which encloses a water container. As it is pushed in radially, the guiding block can come up against this peripheral wall, as a result of which a stop, which limits its inward movement, is formed.

Finally, it is necessary to take care that the guiding block cannot migrate outward in operation, taking along the tensioning device. For this purpose, a hood, which is present anyhow in the case of such stands and covers the foot part towards the top, is advantageously used. Such a hood is provided with functional openings, through which the rod-shaped part can be introduced into the stand and which are also required for the tensioning lever and the holding elements. Therefore, in the case of such a stand, which is equipped with a hood, covering the foot part and provided with functional openings, at least one stop is constructed at this hood. When the hood is placed down, the stop interacts with the guiding block and prevents the latter being pushed in a direction radially towards the outside.

The principle of modular construction, which is expressed clearly in all its refinements in the third embodiment, and the setting up merely by joining together without special fastening means, can also be extended to other components. For example, a development is possible according to which the guiding walls, guiding the guiding block, at the same time function as axial safeguard of an axle of the tensioning device, which is constructed as a through axle and belongs to a drum, which winds up the flexible connecting part and/or to a tensioning lever. As a result of this construction, the through axle of the tensioning device need not be fixed axially to the latter itself. After the whole of the stand has been assembled, the axle is reliably secure and held axially. By these means, it becomes possible to install the tensioning device only by assembling it and without further fastening means.

The principle followed here can be supplemented further owing to the fact that the holding elements are fastened to the foot part of the stand only owing to the fact that they, together with their pivoting pegs or the like, are fastened as ready-to-install components in the seating region of the foot part, it being possible to safeguard against lifting off only by placing down the hood. This possible configuration is, moreover, described in the German patent application 101 63 388.6 of this Applicant.

Figure 2:
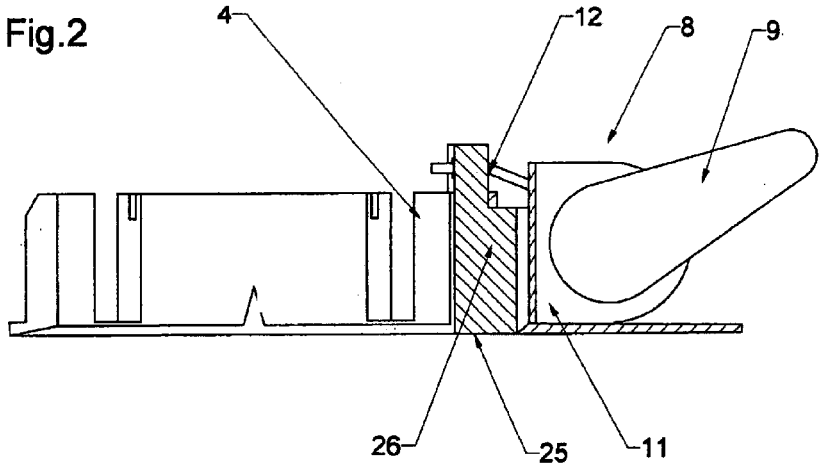
Figure 3:
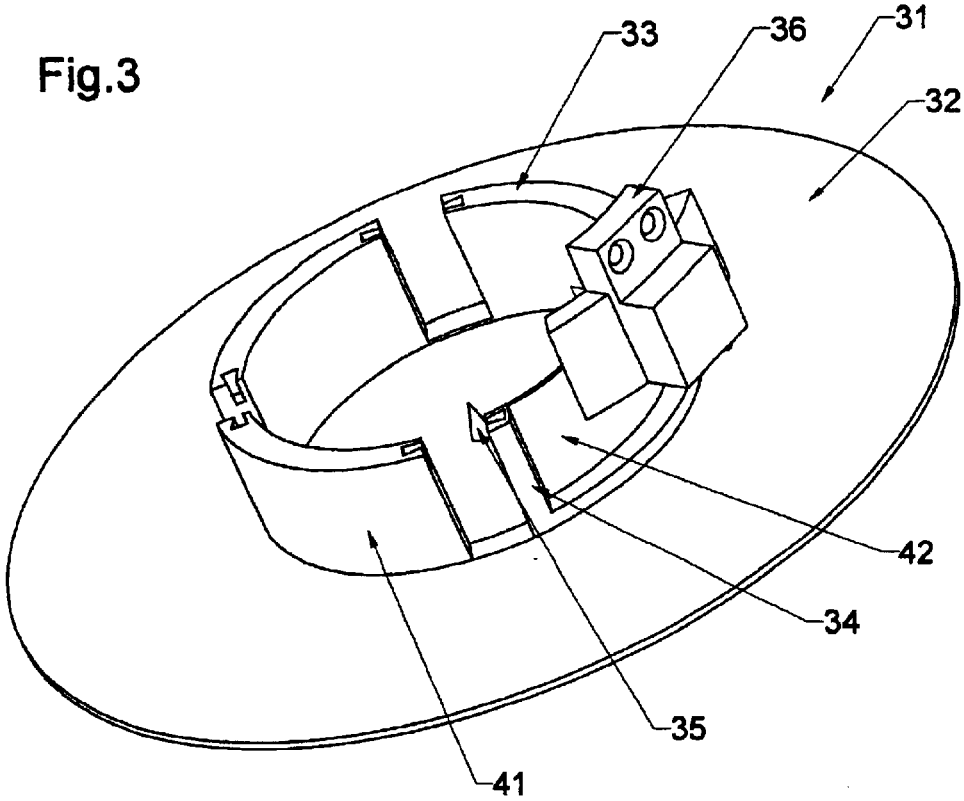
Figure 4:
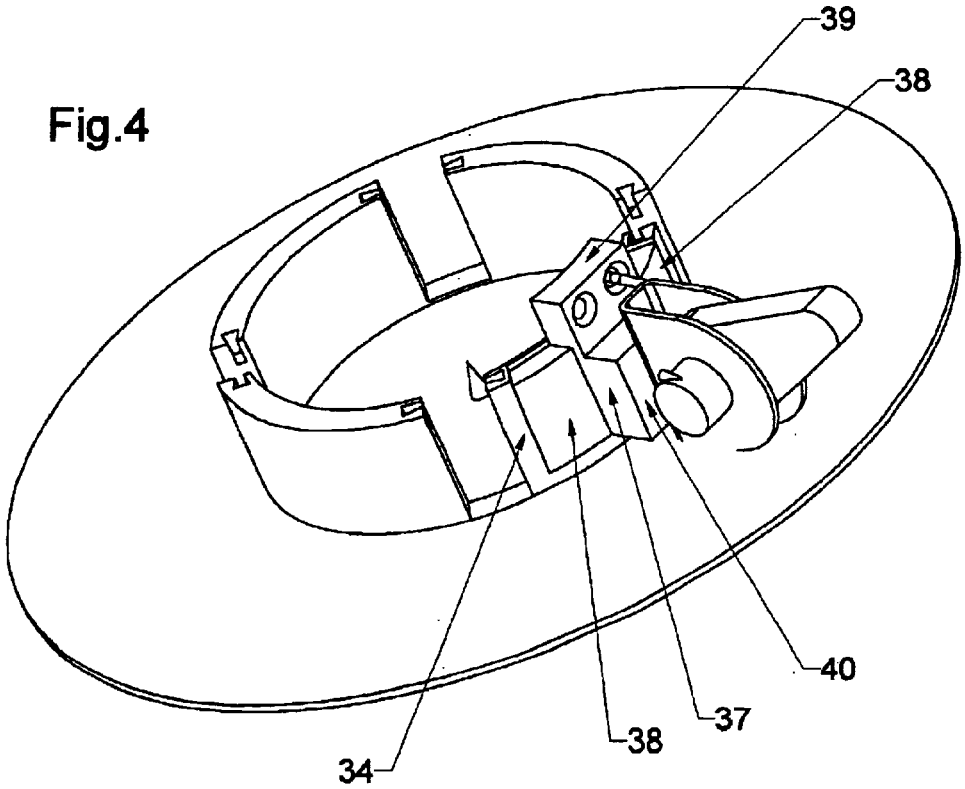
Figure 6:
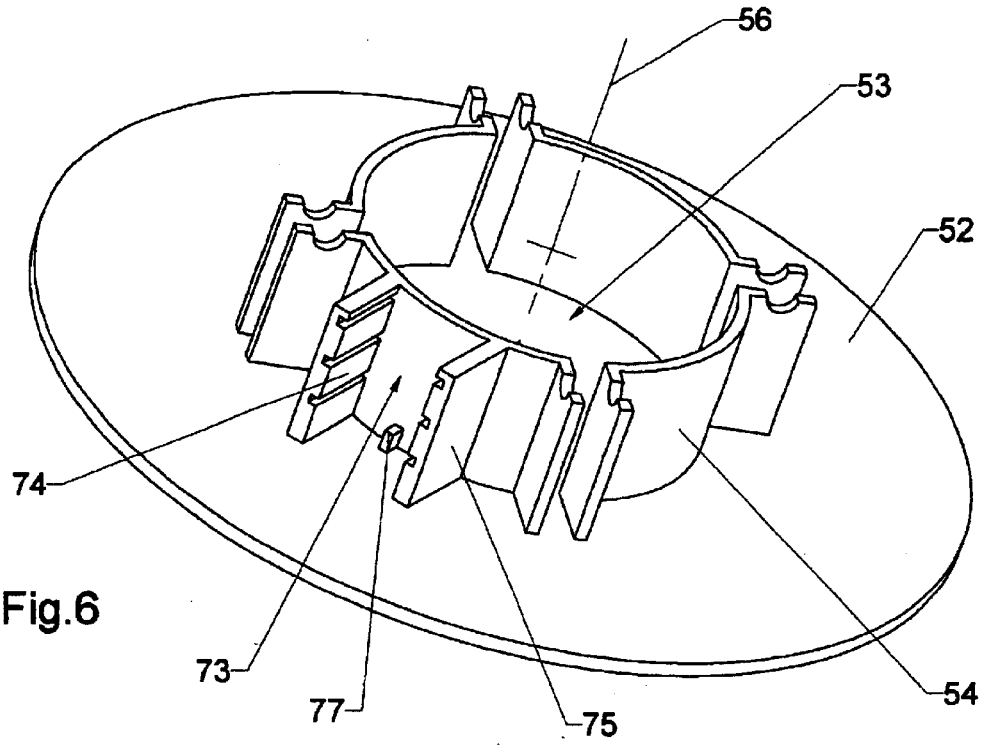
Figure 7:
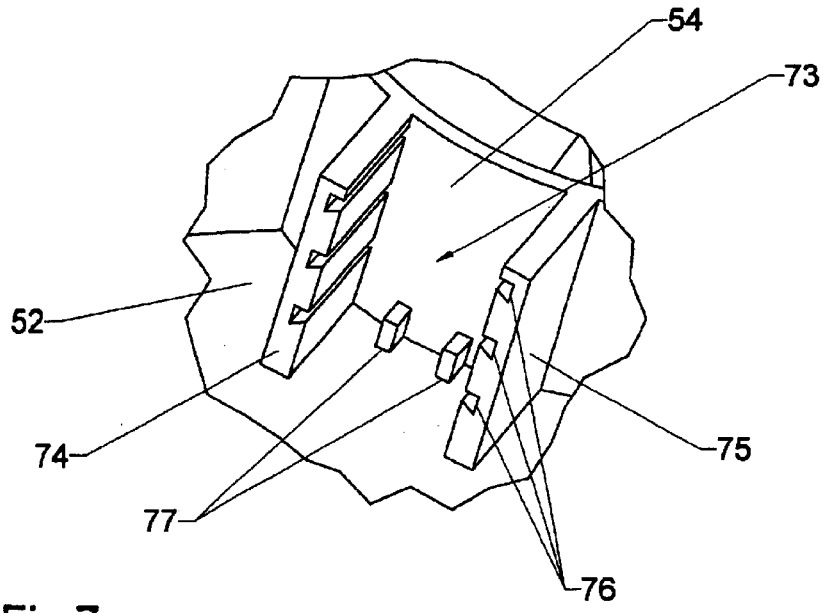
Figure 8:
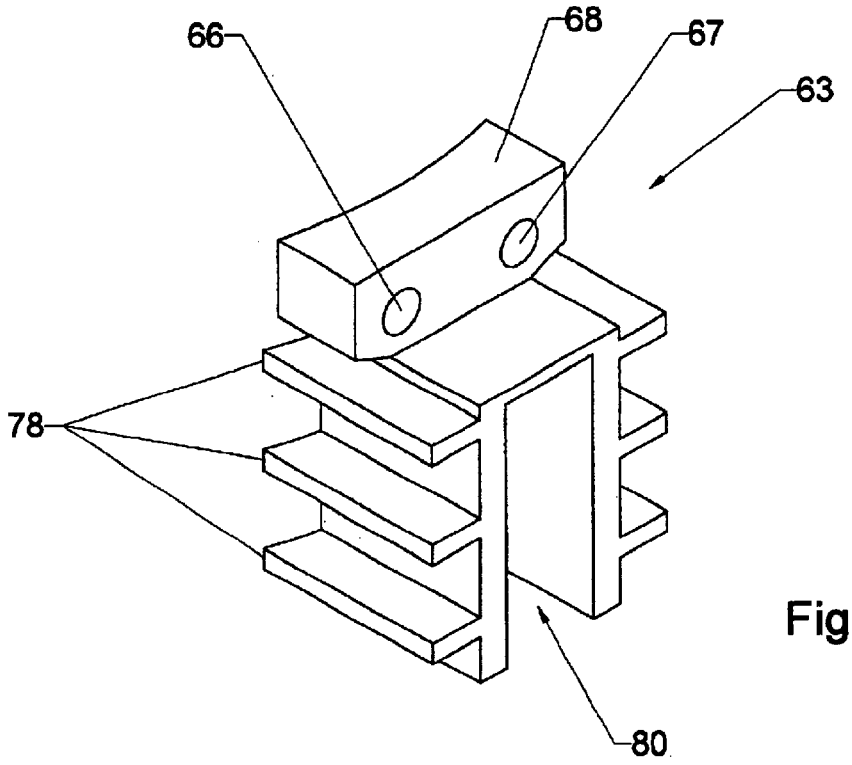
Figure 9:
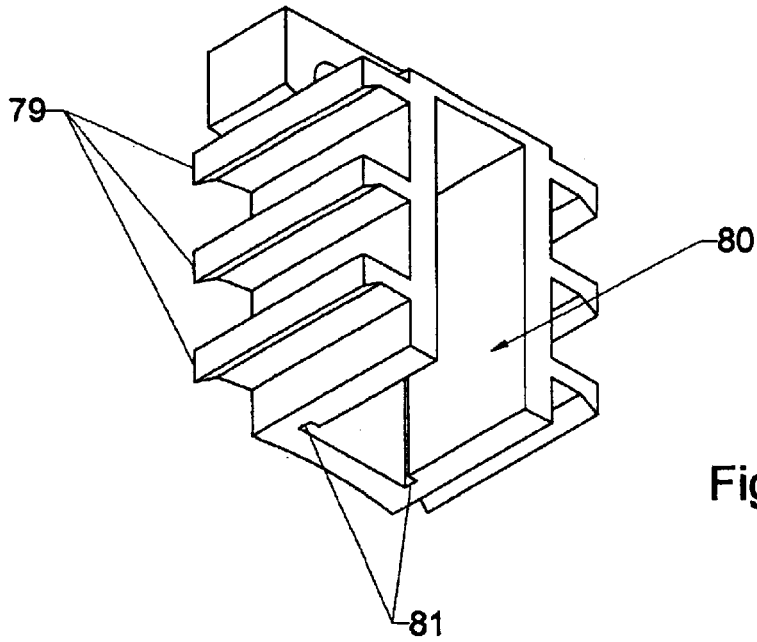
Figure 10:
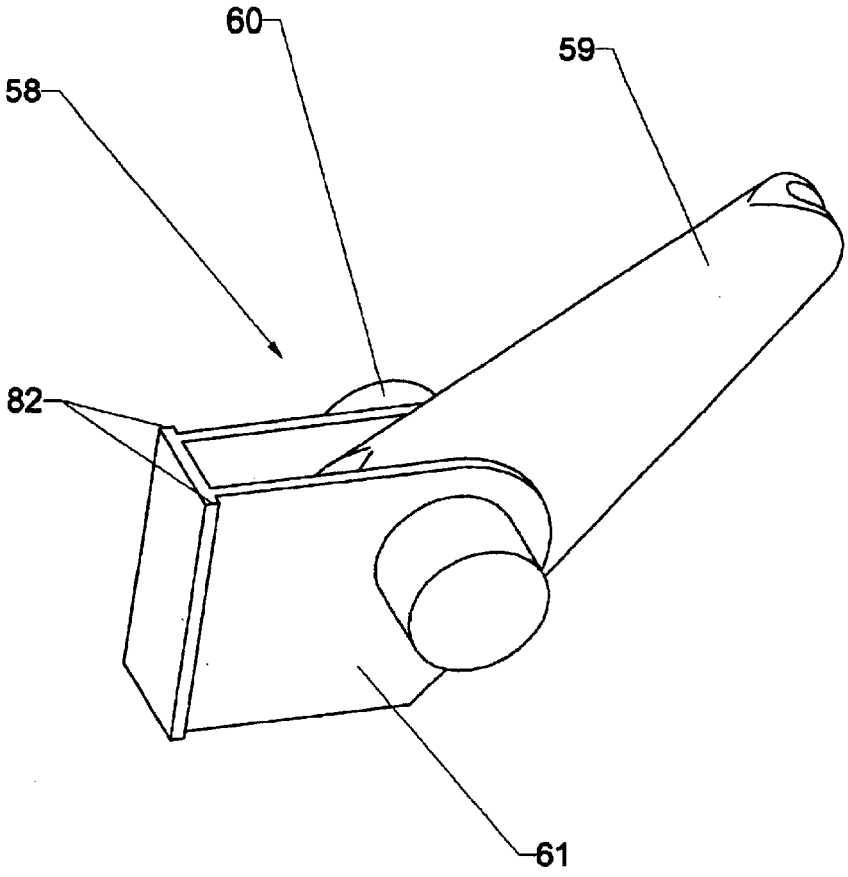
Figure 11:
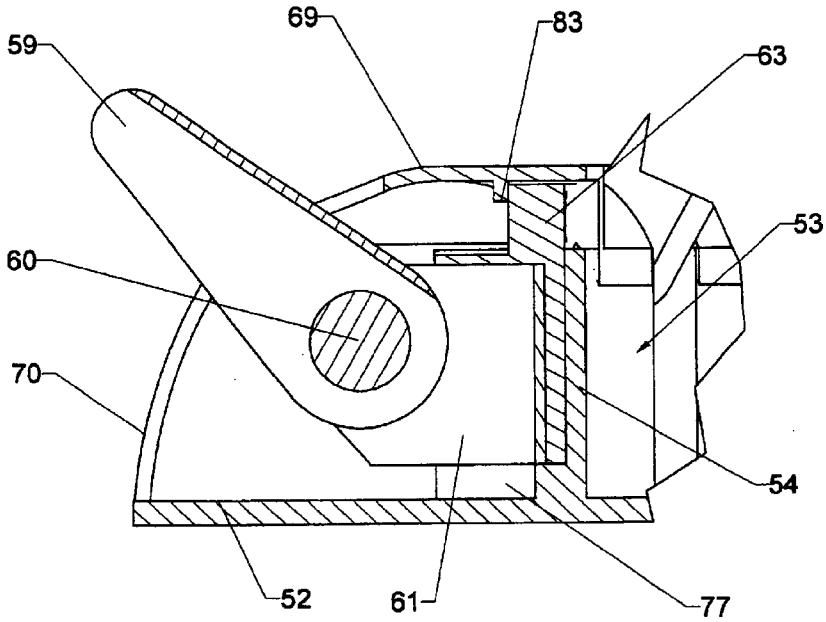

The invention is described below in even greater detail by means of examples, which are shown in the drawings in which FIG. 1 is used to explain the function of the inventive stand in the form of a plan view of the foot part from above, FIG. 2 shows a partial section along the line A—A of FIG. 1 and reproduces a first inventive embodiment, FIG. 3 is a 3-dimensional representation of a second construction, for which the guiding block is inserted from the outside radially into the seating region of the foot part, FIG. 4 shows a representation, corresponding to FIG. 3, the guiding block being inserted completely into the recess of the circular wall contour, FIG. 5 shows a 3-dimensional representation of a third inventive stand, the associated hood, which is to be placed on the foot part from above, also being shown, FIG. 6 shows a representation of the foot part by itself without further fittings for the embodiment of FIG. 5, FIG. 7 a detail of FIG. 6 on an enlarged scale, in which there have been some modifications to the representation of FIG. 6, FIG. 8 shows an enlarged representation of the guiding block of the third embodiment of FIGS. 5 to 7, FIG. 9 shows a representation, corresponding to that of FIG. 8, from a different viewing angle, FIG. 10 illustrates the tensioning device, which is intended for installing the inventive stand of FIGS. 5 and 7, FIG. 11 shows a section through the stand of the third embodiment in the assembled state, the section extending radially through the region of the tensioning device and FIG. 12 also shows a sectional representation of the installed fourth embodiment, a section line, passing transversely through the guiding block and perpendicular to its insertion direction having been selected.

In the representation of the first inventive construction of FIGS. 1 and 2, the foot part 1 of an inventive stand consists of a base plate 2, which is provided with a seating region 3. The seating region 3 has the shape of a circular wall contour, in the simplest embodiment, a container with a wall in the shape of a cylindrical ring.

However, in the example shown, the circular wall contour is formed by individual wall regions 4. Holding elements 7 are pivotally disposed in the gaps between the individual wall regions. They move in pivoting planes, which, in a symmetrical arrangement, all point to an axis of symmetry 6. The axis of symmetry 6 is in the axial extension of an arbor 5, which serves for the first fixing and radially adjusting rod rod-shaped parts, which consist, for example of wood. The axis of symmetry is aligned perpendicularly to the plane of the base plate 2.

At the foot part, there is a tensioning device 8, which is actuated by means of a tensioning lever 9. The tensioning lever 9 may be constructed, for example, as a foot pedal. The tensioning lever 9 is connected with a drum 10, on which the flexible connecting part 12 is wound up and tensioned. The tensioning device may be a rope, winch or a ratchet. Its structure is conventional and is therefore not described in detail. It is in its own housing 11 and incorporated as a whole in the foot part.

In practice, the flexible connecting part 12 is a steel rope, which is passed through boreholes in the holding elements 7. When the tensioning device 8 is actuated, the flexible connecting part 12 pulls the holding elements 7 out of an open position, in which the rod-shaped part can be placed effortlessly from above into the seating region 3, initially in a contacting position and then in a holding or clamping position. Because of the special guidance of the rope, all holding elements contact the fastening end of the rod-shaped part with essentially the same holding force. The details of such a tensioning device are described and shown, for example, in the DE 39 32 473 C2, so that this publication can be referred to in this regard. The tensioning elements are shown in their holding position in FIGS. 1 and 2.

For the functioning of such a stand, it is advantageous if the flexible connecting part, when seen from above, as far as possible has the shape of a regular polygon, which lies in a horizontal plane. This desirable shape comes about largely owing to the fact that, according to the representation in FIG. 1, the ends of the flexible connecting part, at one place in the region of the holding elements, are passed together and radially to the outside to the tensioning device 8. In the representation of FIG. 1, these ends are the first end 14 and the second end 15 of the flexible connecting part 12. In FIG. 1, the polygonal shape of the connecting part is reproduced in a simplified manner as a circle.

Obviously, an appreciable load arises at the place, at which the two ends 14, 15 of the flexible connecting part 12 are bought together and connected with the tensioning device 8.

For this reason, a special guiding block 13 is provided at this place. The whole of the foot part may consist of a conventional plastic, which is not particularly expensive. On the other hand, the guiding block is produced from a high-strength plastic. In practice, a nylon, reinforced with glass fibers, has especially proven its value. The guiding block 13 has an upper region, in which the two ends 14, 15 of the flexible connecting part 12 are guided by means of two boreholes. The boreholes may be rounded laterally and also adapted otherwise to the desired guidance of the flexible connecting part, so that there is no unnecessary wear.

The construction of the guiding block 13, which is shown, combines the sparing use of a high-grade plastic with the greatest static reliability.

It can be seen from FIG. 2 that the guiding block 13 is connected directly, that is, without interposing a layer of material belonging to the wall regions 4, with the tensioning device 8. For this purpose, the guiding block 13 of FIG. 6 has a projection 26, which protrudes through an opening 25 in the wall regions 4 and touches the housing 11 of the tensioning device 8 directly. In this way, the danger is avoided that excessive two-dimensional pressure will be exerted on the material of the wall regions 4 in the region of the small end surface of the tensioning device.

A second construction of an inventive stand can be seen in FIGS. 3 and 4. A foot part 31 is provided here with a base plate 32 and a seating region 33. The seating region is formed from individual wall regions 34, which altogether form a circular wall contour 41. The holding elements, which are once again not shown here, are disposed in the gaps between the individual wall regions 34. The usual arbor, in the prolongation of which the axis of symmetry, which is relevant for the pivoting planes of the holding elements, extends, is labeled 34.

The guiding block 36 has a reinforced middle part 37 here and two laterally attached wings 38, which form enlarging contact surfaces. There is a recess 42 in one of the wall regions 34. It is made radially from the outside in the form of a wide groove in the associated wall region 34, so that only a relatively slight layer remains of the material thickness of the wall region. The guiding block 36 is inserted in this recess 42, the back sides of the middle part 37 as well as the wings 38 forming a considerable contacting surface. Accordingly, the wall thicknesses of the material, remaining from the wall region 34, as well as the wall thicknesses of the middle part and of the wing of the guiding block 36 are additive.

A projection at the middle part 37 of the guiding blocks 36 is labeled 40. The guiding block is in contact with the associated tensioning device, which is not shown here, with the relatively small front surface of the projection 40. The force, acting initially on the small front surface of the projection 40, is distributed uniformly over the whole extent of the periphery of the associated wall region 34 and accordingly is transferred gently to the foot part, stress peaks being avoided.

The guiding block 36 may, for example, be glued to the associated wall region 34. The middle part 37 once again has an upper region 39, in which the ends of the flexible connecting part are guided reliably and with little, if any effect on the material.

A third embodiment of the inventive stand with different details is shown in FIGS. 5 to 12. For greater clarity, the flexible connecting part has been omitted in all of the Figures. For this inventive embodiment also, the flexible connecting part is guided in agreement with the variations presented previously and therefore does not have to be shown again.

As is evident from FIG. 5, the stand here also has a foot part 51 with a base plate 52, from which a seating region 53 extends upward. The seating region 53 has the shape here of a peripheral wall 54, which may enclose, for example, a water container. Furthermore, the arbor 55, in the extension of which the axis of symmetry 56, which is relevant for the stand, is located, may be recognized in FIG. 5. For a better descriptiveness, this axis of symmetry 56 has also been drawn in FIG. 6. Around the seating region 53, the holding elements 57 have been mounted pivotably and can be drawn inward by the known flexible connecting part into the holding position, in which they clamp the rod-shaped part.

Here also, the tensioning device 58, of which the tensioning lever 59, a through axle 60 and the housing 61 can be recognized in FIG. 5, is used for tensioning the flexible connecting part. The tensioning lever 59 is mounted on the through axle 60, which can be used at the same time as a drum for winding up the flexible connecting part.

The guiding block, which is shown in greater detail in FIGS. 8 and 9, is labeled 63. The guiding block 63 has a first borehole 66 and a second borehole 67 for guiding the flexible connecting part. Moreover, the two boreholes 66 and 67 are disposed in the upper region 68 of the guiding block.

A hood 69 covers the foot part 51 with all its fittings. The hood 69 has a functional opening 70 for the tensioning lever, a further functional opening 71 for the rod-shaped part as well as four functional openings 72, in which the pivotable holding elements can move. The hood may be connected to the foot part by means of conventional connecting elements, such as a clip-type connection, which is not showing.

A guide 73 is formed at the foot part. It can be seen better in FIGS. 6 and 7 and is formed, according to the representation selected here, by the guiding walls 74 and 75. The guiding walls are formed in one piece with the peripheral wall 54 and the base plate 52 and are therefore a particularly stable component of the foot part 51.

At each of the mutually facing inner sides of the guiding wall 74 and 75, three grooves 76 are formed. The cross section of the grooves may be rectangular (FIG. 6) or undercut (FIG. 7), for example, in the shape of a dovetail. They extend over the whole length of the guiding walls 74 and 75, approximately radially to the axis of symmetry 56.

The ribs 78 or 79, which may be formed at the guiding block 63 correspond to the grooves 76. This can be seen particularly well in FIGS. 8 and 9, which show the guiding block in an enlarged representation. The ribs 78 and 79 are introduced into the grooves 76 so that the guiding block may be pushed into the foot part of the stand. This pushing-in movement comes to a halt owing to the fact that the peripheral wall 54 functions as a stop for the guiding block 63.

Furthermore, FIGS. 8 and 9 clearly show a recess 80, which is open radially to the outside and, in relation to the operating position of the assembled stand, is also open in the downward direction. As can be seen particularly clearly in FIG. 9, the recess 80 expands in width towards the front end of the guiding block and, by these means forms two grooves 81.

The object of FIG. 10 is the representation of the ready-to-install tensioning device 58. The housing 61, the tensioning lever 59 and the through axle 60, which acts as a drum for winding up the flexible connecting part and, at the same time, mounts the tensioning lever 59 pivotably, can be seen clearly. At the front side of the housing 61, which, in the assembled state, is directed towards the inside in the direction of the axis of symmetry 56, there are two guiding ribs 82, the dimensions of which fit those of the guiding grooves 81 in the guiding block 63.

For the assembling process, the tensioning device is pushed from the underside of the guiding block into the recess 80, the dimensions of which also fit those of the housing 61 of the tensioning device 58 precisely. In so doing, the guiding ribs 82 at the housing 61 are taken up by the guiding groove 81 in the guiding block 63. The guiding block and the tensioning device are pushed into one another until the housing 61 comes up against the inside of the upper region 68 of the guiding block 63. This state can be seen well in FIG. 11. Only when the guiding block and the tensioning device have been assembled, is the structural unit, formed thereby, introduced in the radial direction between the guiding walls 74 and 75 into the foot part 51 of the stand. In so doing, the ribs 78 or 79 at the guiding block 63 are taken up by the grooves 76 formed in the guiding walls 74 and 75. This radial pushing-in movement is concluded as soon as the front side of the guiding block 63 comes up against the peripheral wall 54 of the seating region 53. This can also be seen well in FIG. 11.

Figure 12:
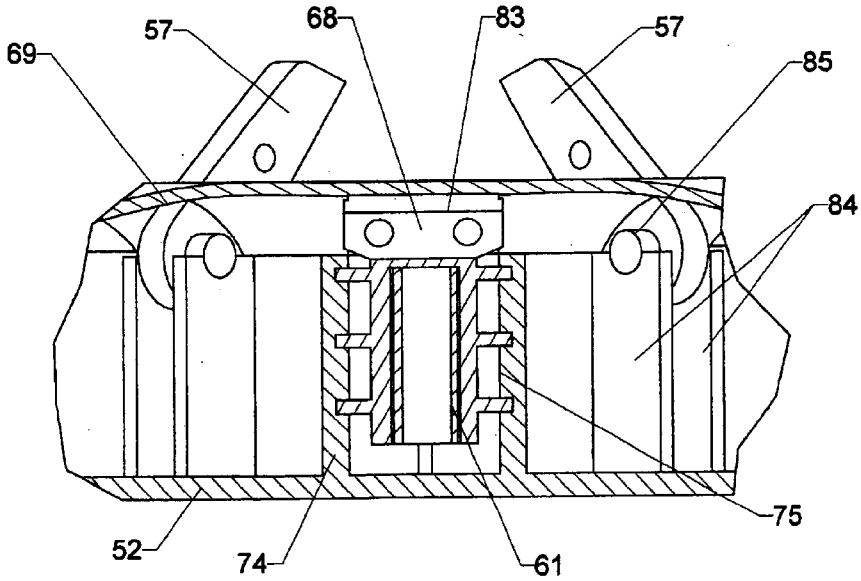

FIG. 12 shows a corresponding representation in a sectional direction, which extends perpendicularly thereto and perpendicularly to the pushing-in movement of the guiding block.

Cams 77, which have previously not yet been mentioned, are shown in FIGS. 6 and 7. A construction with a single cam is selected in FIG. 6 and one with two cams 77 is selected in FIG. 7. These cams prevent any independent, unintentional shifting downward of the tensioning device within the guiding block 63 as soon as the guiding block has been pushed completely in the radial direction, between the guiding walls 74 and 75. This is shown clearly in FIG. 11. It can be seen that, when the guiding block is pushed in, the housing 61 can no longer migrate downward, because its path is now blocked by the cam or cams 77. So that the goal of blocking the mutually assembled parts completely is achieved, the guiding block must now be prevented from automatically migrating radially outward during the operation. This is accomplished by the stop 83 at the hood 69, which is drawn and labeled in FIGS. 5, 11 and 12. As soon as the hood 69 has been placed on the foot part 51, the stop engages behind the upper region 68 of the guiding block 63, so that the guiding block is now enclosed in the radial direction between the stop 83 and the peripheral wall 54, which also functions as a stop.

The way of assembling the stand of the third embodiment, described here, has various advantages. On the one hand, the parts are assembled consecutively without tools and without additional connecting elements such as screws or the like and, at the conclusion of the assembly, reliably remain mutually blocked and locked. Contributing to this is the fact that the pushing-in directions, on the one hand, of the tensioning device into the guiding block and, on the other, of the guiding block into the foot part of the stand are mutually perpendicular to one another and that this type of assembly is supplemented by the cams and stops, which have been mentioned.

Moreover, the embodiments of FIGS. 5 to 11 make the production and assembly of individual components according to the modular technique possible in a particularly advantageous manner. For example, the foot part, guiding block and tensioning device can be produced prefabricated and only finally assembled in different places and, moreover also, in different combinations. For example, different foot parts can be combined with different tensioning devices and the like without the need for major structural changes.

The type of modular assembly, described here, can be extended further. For example, FIGS. 5 and 6 clearly show that the holding elements 57 can be mounted pivotably by means of swivel pins 85 on supporting and bearing walls 84, which, like the guiding walls 74 and 75, start out from the peripheral wall 54 and are permanently connected with the latter as well as with the base plate 52. These holding elements can be connected permanently by means of the bolts supporting them either positively or adhesion, that is, without the use of additional fastening elements, with the seating region 53. Here also, the holding elements can be prevented from lifting off in the upward direction by stops, which are at the hood. Moreover, there is a detailed description of how such holding elements can be fastened to the stand in the German patent application 101 63 388.6.

An economic way of assembling the stand may consist therein, that, at a first assembly site, the holding elements, the flexible connecting part and the tensioning device are assembled into a loosely coherent assembly. Only during the final installation are the holding elements and the guiding block then inserted into the foot part. This is easily possible in spite of the already existing connection over the flexible connection part. In this way, the individual steps of the assembly can be carried out by specially trained personnel, so that an especially good economic efficiency is achieved.

The type of assembly, described here, can also be transferred to the tensioning device 58. As already mentioned, the axle for the tensioning lever 59, which at the same time may be the drum for winding up the flexible connecting part, is constructed as a through axle 60, which itself is not fixed to the tensioning device. Due to the possibility (now shown) of extending the guiding walls 74 and 75 radially towards the outside as far as the region of the through axle 60, reliable locking of the through axle 60 in its axial direction results, because, in the case of such a construction, the through axle 60 is held reliably at both sides after the assembly. This opens up the possibility of installing the tensioning device also only by assembling it, without additionally using screws, retaining rings and the like.

With regard to the ribs 78 or 79 at the guiding block 63, there is the possibility, which is shown, that the ribs change over with round corners into the adjacent side surfaces of the guiding block. At the same time, the dimensions can be such that, in the assembled state, an interval or gap is formed between the side wall regions of the guiding block in the adjacent guiding walls. This construction leads to an improved elasticity of the ribs in the region, in which they are connected with the guiding block, so that the load-carrying ability and the service life of this highly stressed connection is improved appreciably.

List of Reference Symbols

1. Foot part
2. Base plate
3. Seating region
4. Wall region
5. Arbor
6. Axis of Symmetry
7. Holding Element
8. Tensioning device
9. Tensioning lever
10. Drum
11. Housing
12. Flexible connecting part
13. Guiding block
14. First end of the connecting part
15. Second end of the connecting part
25. Opening
26. Projection
31. Foot part
32. Base plate
33. Seating region
34. Wall region
35. Arbor
36. Guiding block
37. Middle part
38. Wing
39. Guiding region
40. Projection
41. Wall contour
42. Recess
51. Foot part
52. Base plate
53. Seating region
54. Peripheral wall
55. Arbor
56. Axis of symmetry
57. Holding element
58. Tensioning device
59. Tensioning lever
60. Through axle
61. Housing
63. Guiding block
66. First borehole in the guiding block
67. Second borehole in the guiding block
68. Upper region of the guiding block
69. Hood
70. Functional opening for the tensioning lever
71. Functional opening for the rod-shaped part
72. Functional opening for holding element
73. Guide
74. Guiding wall
75. Grooves
76. Cams
77. Ribs, rectangular cross section
78. Ribs, undercut, cross section
79. Guiding wall
80. Recess
81. Guiding groove for tensioning device
82. Guiding rib.

What is claimed is:

1. A stand for clamping a rod-shaped part comprising a foot part having a seating region for an end of the rod-shaped part, the seating region being formed by a contoured wall, a plurality of holding elements disposed around an axis of symmetry, each of the holding elements being swivelable in a respective plane between an open position and a holding position, the planes intersecting approximately in the axis of symmetry, a tensioning device, a flexible connecting part tensioned by the tensioning device, the tensioning device being guided in the form of an approximately closed loop movably through all the holding elements, actuation of the tensioning device effecting swiveling of the holding elements from the open position into the holding position, a guiding part provided at the foot part, at least one end of the flexible connecting part being guided by the guiding part away from the loop and the axis of symmetry, the guiding part comprising a guiding block, the contoured wall having a recess in which the guiding block is received, the guiding block being in direct contact with the tensioning device, whereby a reaction force, corresponding to a tensile force, is transferred from the tensioning device to the foot part.

2. The stand of claim 1, wherein the foot part comprises plastic and the guiding block comprises a nylon.

3. The stand of claim 1, wherein the flexible connecting part has two ends, both said ends pass through the guiding block to the tensioning device and are connected with the tensioning device.

4. The stand of claim 3, wherein the guiding block has two boreholes and each of said ends of the flexible connecting part is passed through a respective one of said boreholes.

5. The stand of claim 4, wherein the contoured wall is of circular configuration, the foot part comprises a base plate, the contoured wall extends from the base plate at substantially right angles to its circular configuration, and the recess has an opening at an underside of the contoured wall, the guiding block being received in the recess through said opening.

6. The stand of claim 5, wherein the tensioning device is disposed at the contoured wall adjacent the guiding block and oriented approximately radially in relation to the axis of symmetry.

7. The stand of claim 6, wherein the guiding block is provided with a projection, the projection extending through the opening, being in contact with the tensioning device and transferring forces.

8. The stand of claim 3 or 4, wherein the foot part comprises a base plate, the contoured wall is of circular configuration and extends from the base plate at substantially right angles to the circular configuration and the guiding block mates with the contoured wall.

9. The stand of claim 8, wherein the recess has an opening facing radially outwardly in relation to the axis of symmetry through which the guiding block is received into the recess.

10. The stand of claim 9, wherein the guiding block comprises a reinforced middle part and two lateral wings, the middle part having a region for guiding the ends of the flexible connecting part and being in contact with the tensioning device, the wings forming enlarged contacting surfaces at the contoured wall.

11. The stand of one claim 1 or 2, further comprising a guide which extends radially in relation to the axis of symmetry into the guiding block and a stop which limits an extent to which the guide extends into the guiding block.

12. The stand of claim 11, wherein the guide comprises guiding walls formed at the contoured wall, the guiding walls extending from the seating region to the outside of the contoured wall and the guiding walls having ribs and grooves which hold the guiding block so that the guiding block is slidable in a radial direction relative to the axis of symmetry.

13. The stand of claim 12, further comprising ribs formed on surfaces of the guiding block, the guiding block having rounded corners which define a transition between said surfaces and other, side surfaces of the guiding block, the side walls being at a distance from the guiding walls which are adjacent the side walls when the guiding block is received in the recess.

14. The stand of claim 12, wherein the guiding block ribs have a rectangular or under-cut profile.

15. The stand of claim 11, wherein the guiding block comprises a holding device for the tensioning device.

16. The stand of claim 15, wherein the guiding block has a recess for receiving the tensioning device.

17. The stand of claim 16, wherein the recess in the guiding block is open radially to the outside, in relation to the axis of symmetry, and to the foot part and forms a guide which extends essentially parallel to the axis of symmetry and into which the tensioning device is received from the side facing the foot part up to a stop.

18. The stand of claim 17, further comprising rib and groove profiling which enables the housing to slide in a direction parallel to the axis of symmetry but prevents migration radially to the axis of symmetry, between the housing of the tensioning device and walls of the recess.

19. The stand of claim 17, wherein the stop which limits movement of the tensioning device into the guiding block is formed by the inner wall of an upper region of the guiding block, the upper region functioning as a rope guide and protruding upward over the seating region.

20. The stand of claim 17, further comprising at least one cam, the tensioning device, inserted in the guiding block, being prevented from shifting in the direction of the foot part by said at least one cam, the cam being located in a shifting path of the tensioning device within the guiding block.

21. The stand of claim 11, wherein the stop which limits inward movement of the guiding block in the direction of the axis of symmetry, is formed by the seating region.

22. The stand of claim 11, further comprising a hood covering the foot part and provided with a functional opening, at least one stop formed at the hood and interacting with the guiding block to prevent shifting of the latter in a radial direction away from the axis of symmetry.

23. The stand of claim 12, wherein the tensioning device comprises at least one of a drum and a tensioning lever mounted on an axle retained by the guiding walls, for taking up the flexible connecting part.

24. The stand of claim 1, wherein the nylon is glass fiber-reinforced.

25. The stand of claims 14, wherein the profile is a dovetail profile.

* * * * *